US010563428B2

(12) United States Patent
Schildwachter et al.

(10) Patent No.: US 10,563,428 B2
(45) Date of Patent: Feb. 18, 2020

(54) LATCH BOLT MONITOR USING A REED SWITCH

(71) Applicants: TRINE ACCESS TECHNOLOGY, INC., Bronx, NY (US); William Schildwachter, Danbury, CT (US); Ferdinand Orbeta, Mount Kisco, NY (US)

(72) Inventors: William Schildwachter, Danbury, CT (US); Ferdinand Orbeta, Mount Kisco, NY (US)

(73) Assignee: TRINE ACCESS TECHNOLOGY, INC., Bronx, NY (US)

( * ) Notice: Subject to any disclaimer, the term of this patent is extended or adjusted under 35 U.S.C. 154(b) by 310 days.

(21) Appl. No.: 15/517,367

(22) PCT Filed: Oct. 20, 2015

(86) PCT No.: PCT/US2015/056381

§ 371 (c)(1),
(2) Date: Apr. 6, 2017

(87) PCT Pub. No.: WO2016/064816

PCT Pub. Date: Apr. 28, 2016

(65) Prior Publication Data

US 2017/0292290 A1 Oct. 12, 2017

Related U.S. Application Data

(60) Provisional application No. 62/067,521, filed on Oct. 23, 2014.

(51) Int. Cl.

| | |
|---|---|
| ***E05B 47/00*** | (2006.01) |
| ***E05B 17/00*** | (2006.01) |
| ***E05B 17/22*** | (2006.01) |

(52) U.S. Cl.
CPC ..... *E05B 47/0047* (2013.01); *E05B 17/002* (2013.01); *E05B 17/22* (2013.01)

(58) Field of Classification Search
CPC .... E05B 47/0047; E05B 17/002; E05B 17/22; E05B 47/0046; E05B 47/0696;
(Continued)

(56) References Cited

U.S. PATENT DOCUMENTS 4,380,704 A * 4/1983 Wisda ..... H01H 36/006 307/116
4,415,604 A * 11/1983 Nativi ..... C08F 283/006 427/510

(Continued)

FOREIGN PATENT DOCUMENTS

WO 2014152240 A1 9/2014

OTHER PUBLICATIONS

International Search Report for corresponding application PCT/US2015/056381 dated Jan. 14, 2016.

*Primary Examiner* — Nathan Cumar
(74) *Attorney, Agent, or Firm* — Norris McLaughlin, PA

(57) ABSTRACT

An electrically or manually actuated locking device comprising a magnetic reed switch as a sensor to monitor whether or not the device is locked. The reed switch is mounted on a circuit board to make a sub-assembly and the sub-assembly is coated with a plastic or other synthetic material which is impermeable to water and/or oil and which provides a degree of mechanical protection from breakage. The coated sub-assembly is then mounted within a housing incorporating the locking device. A pivotable magnet carrier which pivots when the bolt of the locking device is engaged causes the reed switch to be actuated.

10 Claims, 5 Drawing Sheets

(58) Field of Classification Search
CPC ..... E05B 63/248; E05B 15/029; E05B 77/34; E05B 17/14; E05B 39/00; E05B 45/00
USPC ..... 292/340
See application file for complete search history.

(56) References Cited

U.S. PATENT DOCUMENTS

| | | | | | |
|---|---|---|---|---|---|
| 5,261,713 | A * | 11/1993 | Fischbach | E05C 19/166 | 292/251.5 |
| 6,304,177 | B1 * | 10/2001 | Nigro, Jr. | E05B 45/12 | 200/61.67 |
| 6,441,735 | B1 * | 8/2002 | Marko | E05B 45/083 | 340/542 |
| 7,503,599 | B2 * | 3/2009 | Ward | E05B 47/0047 | 292/341.15 |
| 2003/0127870 | A1 * | 7/2003 | Schildwachter | E05B 47/0047 | 292/341.16 |
| 2007/0046040 | A1 * | 3/2007 | Chang | E05B 47/0047 | 292/341.16 |

* cited by examiner

LATCH BOLT MONITOR USING A REED SWITCH

CROSS-REFERENCE TO RELATED APPLICATION

This is a non-provisional application claiming priority from provisional application Ser. No. 62/067,521, filed Oct. 23, 2014.

BACKGROUND OF THE INVENTION

Field of the Invention

There is a need to remotely monitor latch bolts and dead bolts, particularly when electric strikes are used. The need also arises from time to time when manual locking devices are used. The present invention has to do with the development of a magnetic reed switch assembly which substantially improves the reliability of remote monitoring and which substantially eliminates the need for maintenance as compared with prior mechanical switches.

The Related Art

Prior to applicants' development of the present invention, mechanical switches were used to monitor the positions of latch bolts or dead bolts, i.e., monitoring whether or not the door was open and, if the latch was engaged, whether or not the dead bolt, if any, was in a locked or unlocked position and to monitor whether the keeper of the electric strike was locked or unlocked. But mechanical switches have a relatively short useful life as compared with the useful life of a latch or dead bolt. Most mechanical switches are comprised of micro switch assemblies which have an electrical life of about 50,000 cycles and a mechanical life of about 100,000 cycles. Electric strikes, on the other hand, may have a useful life of 250,000 cycles or more. Micro switch failure, therefore, requires maintenance several times over the life of the strike. Of course, the mechanical switch requires mechanical actuation which can lead to mechanical failures in addition to electrical failures. Mechanical switches are detrimentally affected by moisture and they can be detrimentally affected by oil. It is also difficult and expensive to protect a mechanical switch from moisture in an outdoor application. The result is that mechanical switches generally are not used in outdoor applications or other applications that may expose them to water.

Magnetic reed switches have not previously been used in lock monitoring because they are delicate and relatively expensive as compared with mechanical switches. But magnetic reed switches have a rated life of 10+ million cycles, far longer than presently available locking mechanisms. Applicants have now invented a design which protects the reed switch within the lock mechanism. And, as to expense, the cost of the reed switch is more than offset by the reduced maintenance costs associated with mechanical switches.

SUMMARY OF THE INVENTION

According to the present invention, a magnetic reed switch is mounted and soldered on a printed circuit board along with wire terminals to make a sub-assembly. Then the sub-assembly is coated one or more times by dipping it in a coating composition such as a plastic or other synthetic material which protects the switch from moisture and oil and which provides a degree of mechanical protection from breakage. The coated sub-assembly is mounted within the strike frame with the terminal wires passing through a hole in the frame. Then a cover is securely placed over the end of the frame wherein the magnetic reed switch is mounted to provide secure mechanical protection. The principles of the invention apply to latch bolts, dead bolts and other locking mechanisms which may be electrically or manually actuable.

DESCRIPTION OF THE PREFERRED ENBODIMENTS

Figure 1:
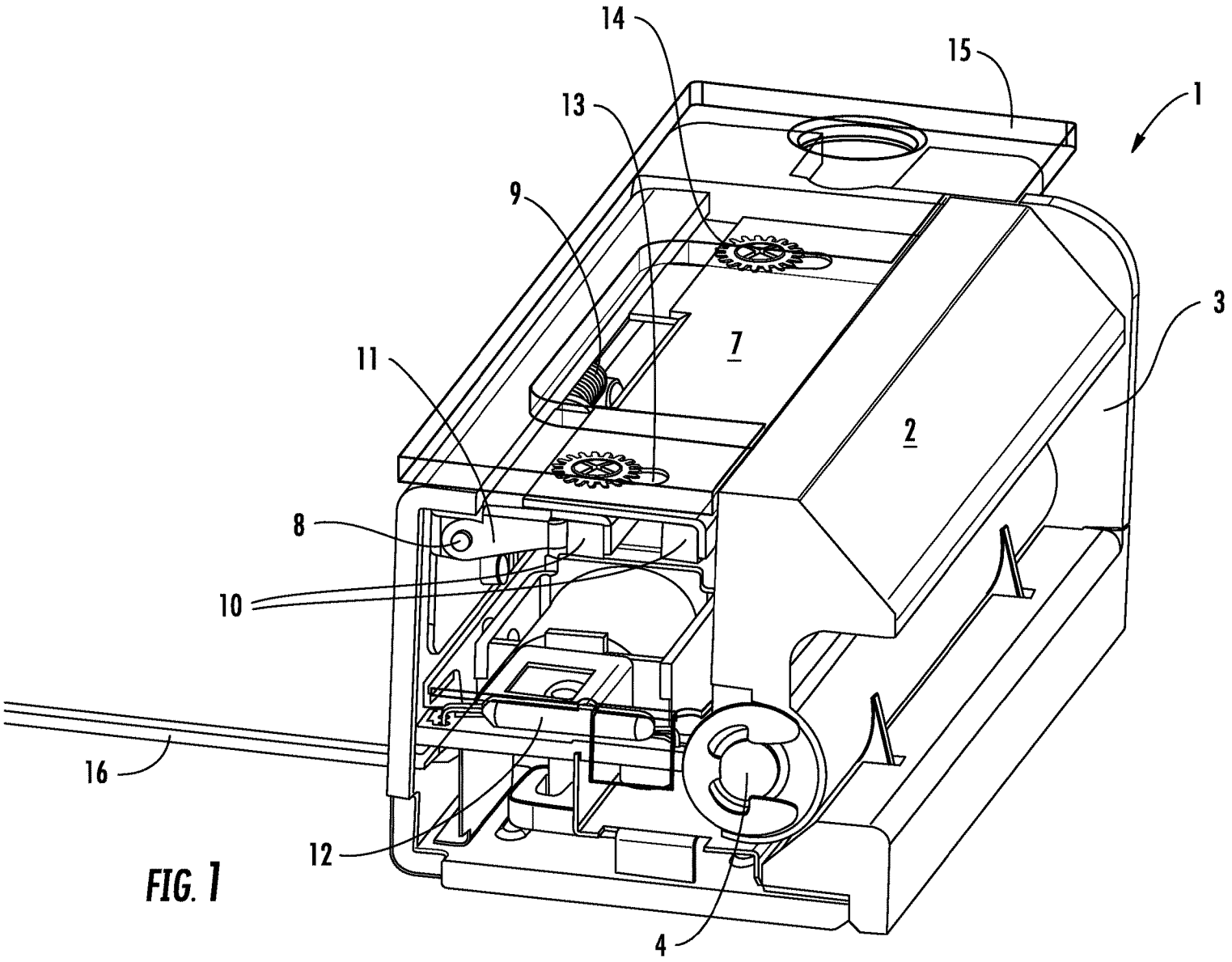
FIG. 1 is a perspective view of an electric strike incorporating the magnetic reed switch of the invention.

In FIG. 1, the electric strike 1 is comprised of a keeper 2 mounted pivotally on a frame 3 by means of a keeper rod 4. Strike 1 further comprises a face plate 15 for affixing strike 1 to a door frame.

Figure 2:
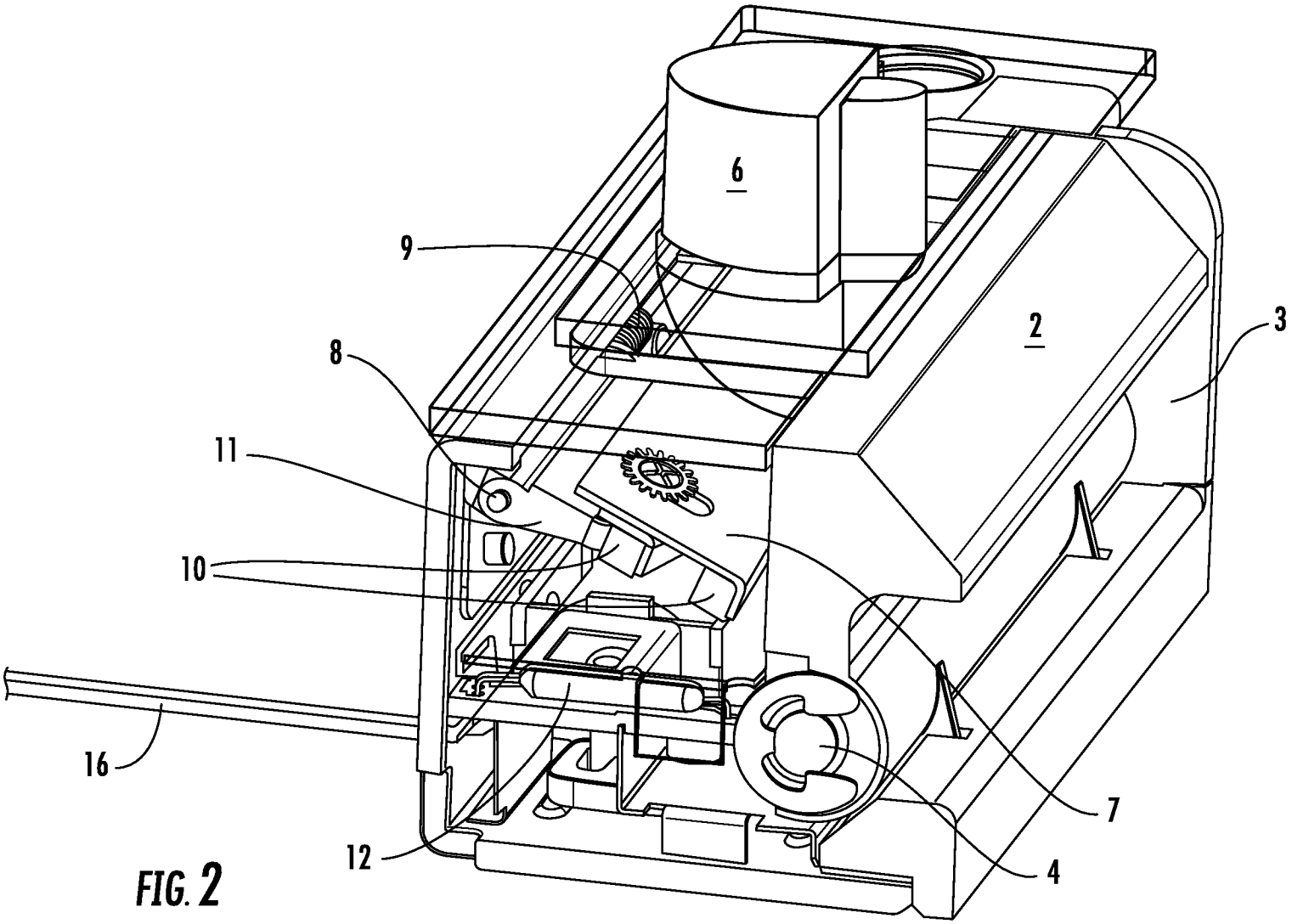
FIG. 2 is a perspective view of a cylindrical lock pushing the magnet carrier actuator plate of the invention.
Figure 3:
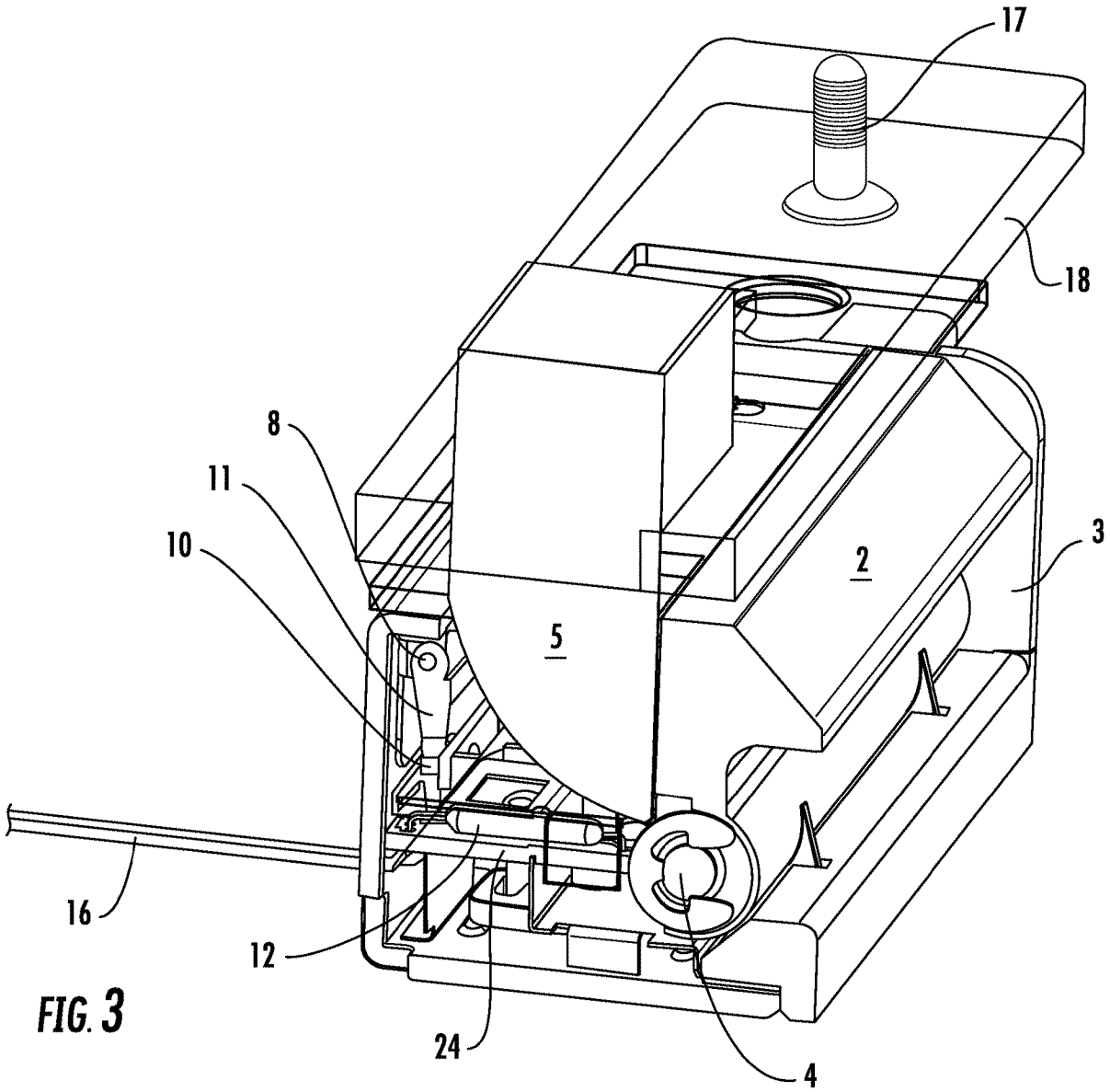
FIG. 3 is a perspective view of a mortise lock pushing the magnet carrier actuator plate of the invention.

The keeper rod 4 is affixed to the housing 3 at the end not shown and the keeper 2 is pivotal around the axis of rod 4. FIG. 3 illustrates a keeper 2 engaged by a latch 5 and FIG. 2 illustrates a cylindrical lockset with a keeper 2 engaged by a bolt 6. FIGS. 1-3 show an actuator plate 7 which is affixed to arm 11. Arm 11 is pivotable on actuator plate rod 8. The actuator plate 7, also referred to herein as a pivotable magnet carrier, is biased in the unlocked position by means of spring 9 shown in FIGS. 1 and 2. At least one actuator magnet 10 is affixed to the actuator plate 7 in a position which will cause the magnet(s) 10 to actuate magnetic reed switch 12. The switch 12 is mounted on circuit board 24 and the combined switch and circuit board are coated with a coating to make a sub-assembly which prevents water and/or oil from damaging the switch. The sub-assembly is mounted on and within the housing 3.

Actuator plate 7 is provided with slots 13 which allow for adjustment of the position of actuator plate 7 using set screws 14. Electrical leads 16 are connected to magnetic reed switch 12. FIG. 3 also illustrates a mounting screw 17 which affixes door plate 18 to a door (not shown).

FIGS. 1, 2, and 3 each show the actuator plate 7 in a different position. In FIG. 1 the plate is in the unlocked position. FIG. 2 shows the plate between the locked and unlocked position and FIG. 3 shows the plate in the locked position. When the plate 7 is in the locked position the magnet(s) 10 actuate magnetic reed switch 12.

Figure 4:
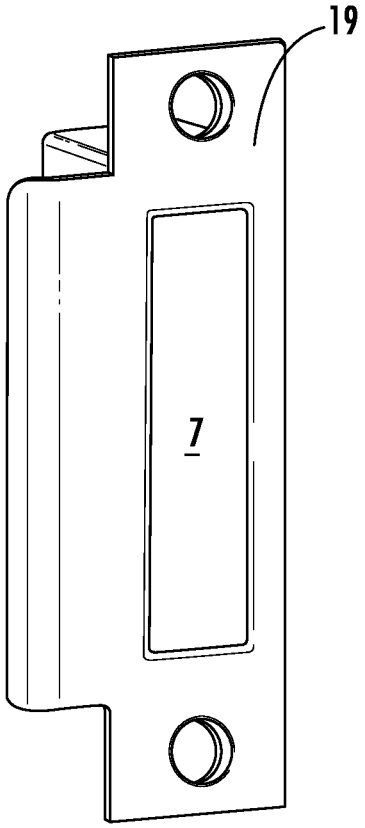
FIG. 4 is a perspective view of the front of a face plate for a latch bolt monitor.
Figure 4A:
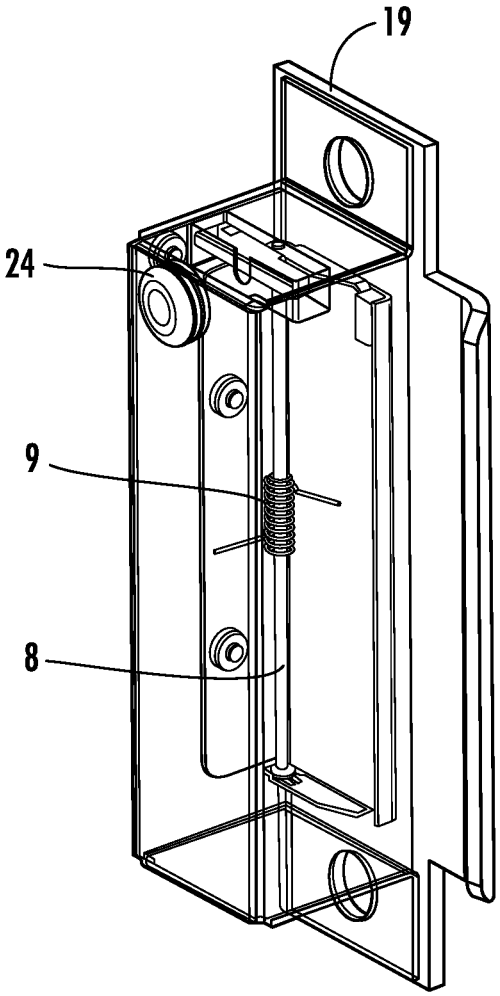
FIG. 4A is a perspective rear view of the plate of FIG. 4.
Figure 5A:
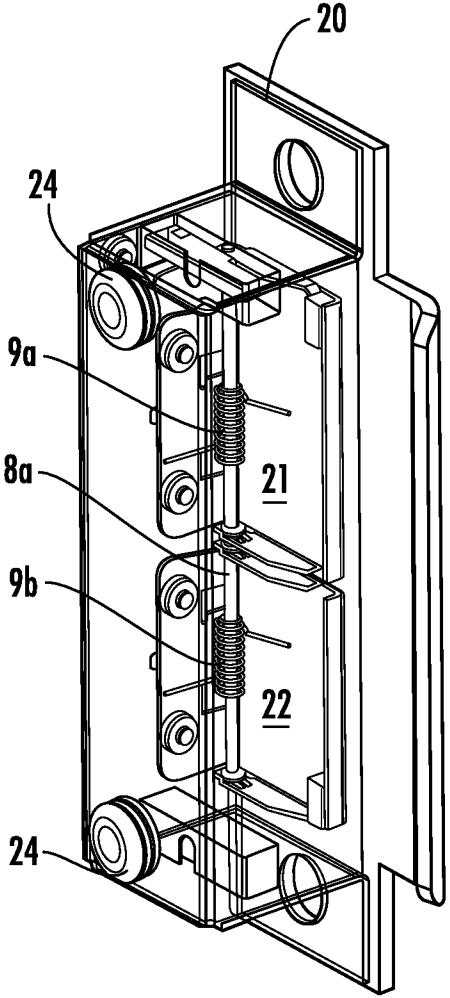
FIG. 5A is a perspective rear view of the face plate of FIG. 5.
Figure 5:
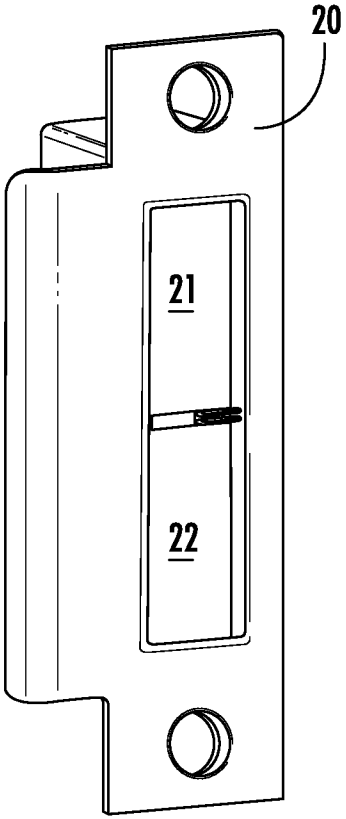
FIG. 5 is a perspective view of the front of a face plate for a latch and dead bolt monitor.

Various face plate embodiments are illustrated in FIGS. 4, 4A, 5 and 5A. In FIGS. 4 and 4A, the face plate 19 is configured for a latch bolt. FIGS. 5 and 5A illustrate a face plate 20 and actuator plates 21 and 22, each of which are independently pivotable about actuator plate rod 8*a* and biased in the unlocked position by springs 9*a* and 9*b*. Actuator plate 21 is actuated by a dead bolt and actuator plate 22 is actuated by a latch bolt. Each actuator plate has associated magnets and an associated magnetic reed switch, the magnets and reed switches being configured and operated in the same way as those illustrated in FIGS. 1-3. Grommets 24 in FIGS. 4A and 5A are for electrical leads 16 to pass therethrough.

Figure 6:
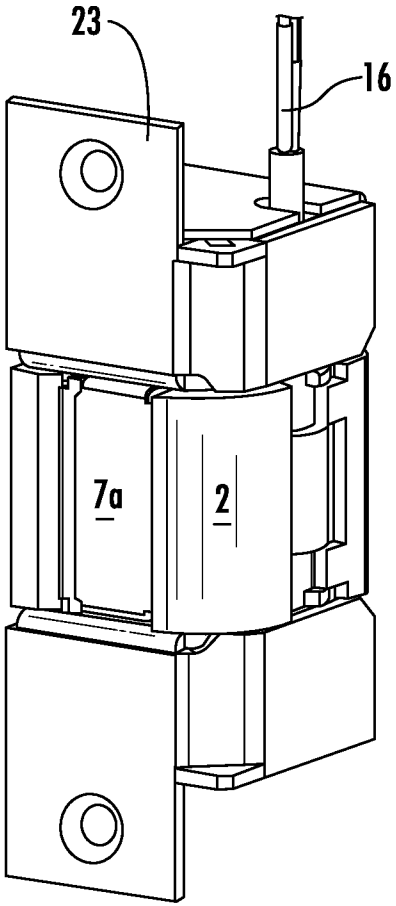
FIG. 6 illustrates another embodiment of an electric strike and face plate in perspective.

FIG. 6 illustrates another embodiment of an electric strike with a face plate 23.

The reed switches used according to the present invention can be magnetically actuated to the "on position" or the "off position" when a magnet is brought close to the switch. The type of switch selected is dictated by the application of the locking device. The same design principles as set forth above are used in electrically actuated dead bolts and other locks and bolts that are manually actuable.

We claim:

1. An electric strike mountable in a door frame adjacent to a latch bolt or dead bolt of a locking device mountable upon a door mountable within the door frame, which electric strike is electrically or manually actuable and which has a housing incorporating components thereof comprising:

affixed to and within the housing, a sub-assembly comprised of a magnetically actuable reed switch mounted on a circuit board, the sub-assembly being sealed with a water and/or oil impermeable coating, and a pivotable magnet carrier which pivots when the latch bolt or the dead bolt of the locking device is engaged and which causes the magnetically actuable reed switch to be actuated.

2. The electric strike of claim 1 wherein the magnetically actuable reed switch is magnetically actuable to the on position.

3. The electric strike of claim 1 wherein the magnetically actuable reed switch is magnetically actuable to the off position.

4. An electric strike mountable in a door frame adjacent to a latch bolt and a dead bolt of a locking device mountable upon a door mountable within the door frame, the electric strike having at least two pivotable magnet carriers each of which is electrically or manually actuable, and which has a housing incorporating components thereof comprising, affixed to and within the housing a first magnetically actuable reed switch mounted on a circuit board as a first sub-assembly, the first sub-assembly being sealed with a water and/or oil permeable coating to make a scaled first sub-assembly, and a second magnetically actuable reed switch mounted on a circuit board as a second sub-assembly, the second sub-assembly being sealed with a water and/or oil impermeable coating to make a sealed second sub-assembly, a first pivotable magnet carrier which pivots when the latch bolt is engaged and causes the first magnetically actuable reed switch to be actuated, and a second pivotable magnet carrier which pivots when the dead bolt is engaged causes the second magnetically actuable reed switch to be actuated.

5. The electric strike of claim 4 wherein the first magnetically actuable reed switch and the second magnetically actuable reed switch each are magnetically actuable to the on position.

6. The electric strike of claim 4 wherein the first magnetically actuable reed switch and the second magnetically actuable reed switch each are magnetically actuable to the off position.

7. The electric strike of claim 1, wherein the pivotable magnetic carrier is biased by a spring.

8. The electric strike of claim 1, wherein the pivotable magnetic carrier is provided with slots which allow for adjustment of the position of the actuator plate and a magnet mounted thereon.

9. The electric strike of claim 4, wherein each of the pivotable magnetic carriers is biased by a spring.

10. The electric strike of claim 1, wherein each of the pivotable magnetic carriers is provided with slots which allow for adjustment of the position of the actuator plate and a magnet mounted thereon.

* * * * *